United States Patent [19]

Tricoli

[11] 4,010,957

[45] Mar. 8, 1977

[54] SPORTS GAME BOARD

[76] Inventor: Russell Tricoli, 729 Humboldt St., Secaucus, N.J. 07094

[22] Filed: Mar. 29, 1976

[21] Appl. No.: 671,321

[52] U.S. Cl. ..... 273/134 AD; 273/134 AT; 273/134 B; 273/134 D

[51] Int. Cl.[2] ..... A63F 3/00

[58] Field of Search ..... 273/134

[56] References Cited

UNITED STATES PATENTS

| | | | |
|---|---|---|---|
| 2,026,082 | 12/1935 | Darrow | 273/134 AD |
| 3,759,520 | 9/1973 | Straitwell | 273/134 AD |
| 3,807,739 | 4/1974 | Henley et al. | 273/134 AF |
| 3,961,795 | 6/1976 | Anspach | 273/134 AD |

FOREIGN PATENTS OR APPLICATIONS

| | | | |
|---|---|---|---|
| 627,951 | 8/1949 | United Kingdom | 273/134 AD |

*Primary Examiner*—Delbert B. Lowe
*Attorney, Agent, or Firm*—Robert D. Farkas

[57] ABSTRACT

A game board represents various aspects of team sports including opportunities to acquire teams and team players involved in baseball, football, hockey and basketball. The board has a rectangular playing path with successive spaces having indicia of specific professional sports teams, and special bonus and penalty cards. A chance device determines the movement of selected player pieces to given spaces. The players can buy the teams designated on the spaces and buy team players when the pieces land in a specific BUY space. When a player piece lands on a team space owned by another player, various payments are required. The payments increase with the number of team players owned and the number of teams owned which have a common color designation. Stacks of cards related to bonus and penalty spaces provide various monetary awards, fines and directions.

10 Claims, 6 Drawing Figures

SPORTS GAME BOARD

FIELD OF THE INVENTION

The present invention relates to game boards and particularly to a game involving team sports and the acquisition of teams and players.

DESCRIPTION OF THE PRIOR ART

Many game boards are known involving specific activities such as property ownership, stock market operations and sports games. Examples of these are shown in U.S. Pat. No. 2,026,082, issued Dec. 31, 1935, Ser. No. 3,799,552 issued Mar. 26, 1974, and Ser. No. 3,826,498, issued July 30, 1974. None of these, however, are known to involve the operations of team sports including the acquisition of teams and players of popular games such as baseball, football, basketball and hockey.

SUMMARY OF THE INVENTION

It is therefore the primary object of the present invention to provide a game board which involves the operations of team sports and opportunities to build and acquire teams and players along with related monetary gains.

This is achieved with a game board having a rectangular path including successive spaces indicating various well known professional sports teams in baseball, football, hockey and basketball, as well as bonus and penalty cards and other activities. The players take turns with a means of chance such as dice to determine the number of spaces moved by selected player pieces. When the pieces land on unowned team spaces, those teams can be purchased. Team players can also be bought when landing on a special BUY space. Payments are required by players when their pieces land on teams that are owned by others. The payments increase with the number of team players owned for that team, up to a full team limit, and with the number of teams owned having a common color designation. Stacks of bonus, penalty and special team bonus cards corresponding to specific board spaces provide various awards, fines and other directions. Other objects and advantages will become apparent from the following description in conjunction with the accompanying drawings.

DESCRIPTION OF THE PREFERRED EMBODIMENT

Figure 1:
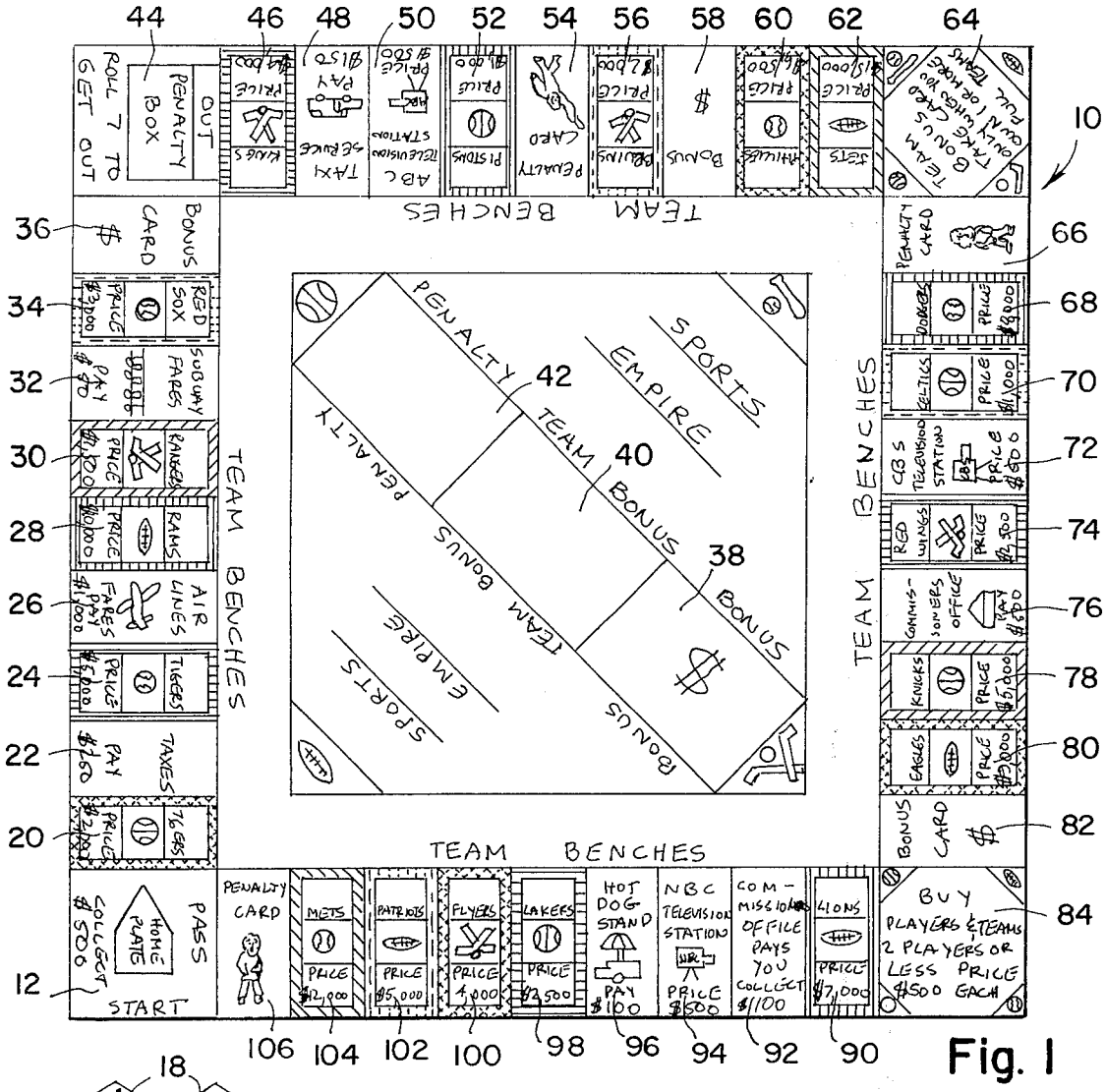
FIG. 1 is a top view of the board showing the various teams and other spaces.
Figure 3:
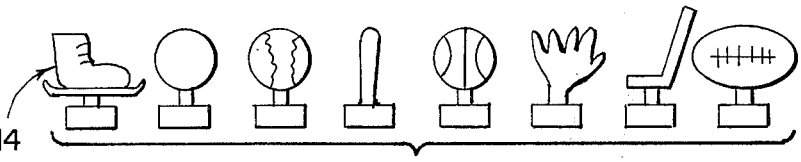
FIG. 3 shows various player pieces in the form of sports equipment.
Figure 4:
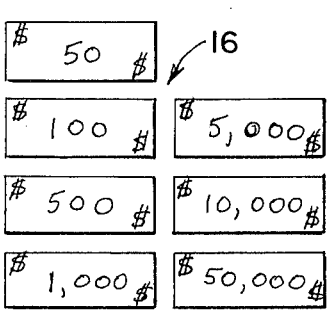
FIG. 4 shows various denominations of play money.

As shown in FIG. 1, a game board 10 includes a rectangular playing path having forty successive spaces distributed along four sides of the board. Space 12 at the lower left hand corner is the Start position which also indicates a home plate, as in a baseball game. Player pieces 14, in the form of various sports equipment as shown in FIG. 3, are selected by respective players of the game and initially positioned on the Start space. Each time the pieces pass this space, the players collect $500 of play money 16, as shown in FIG. 4. The players each receive $100,000 at the beginning of the game in various denominations. A person chosen to be the Commissioner holds the balance of the money and collects and pays various fines, purchases and awards.

Figure 2:
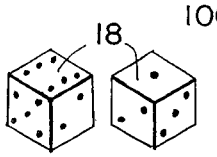
FIG. 2 is a pictorial representation of a pair of dice used as the means of chance.

A roll of the dice 18, of FIG. 2, determines the number of spaces moved by the player pieces. The successive spaces along the left side include space 20 which indicates the 76ers basketball team, having a purchase price of $2,000, and an orange colored border. As will be seen, monetary advantages accrue to the owner of a group of teams having the same color designation. There are five groups of four teams with the same color, each group including a baseball, football, basketball and hockey team, which are distributed so that the five group colors are each represented once on each side of the board.

Thus, continuing on the left side, an intermediate space 22 indicates TAXES — Pay $250, which must be paid to the Commissioner who acts as a Banker. The next space 24 indicates the Tigers baseball team having a red border, which may be purchased for $5,000, if not already owned by another player. Each time a player piece is moved after a throw of the dice, the player must follow the directions on the board, such as paying a fee, or he may purchase the team on which the piece lands. When another player owns that team, various penalties must be paid as will be further explained. The next intermediate space 26 indicates AIR LINE FARE — Pay $1,000, which is again paid to the Commissioner. Space 28 indicates the Rams football team, having a blue border and price of $10,000, while space 30 indicates the Rangers hockey team, with a green border and price of $7,500. The next space 32 indicates SUBWAY FARES — Pay $50, and space 34 indicates the Red Sox baseball team, having a purple border and a price of $3,000.

The next space 36 indicates a Bonus Card. Three stacks of cards and spaces 38, 40, 42 for Bonus, Team Bonus and Penalty are arranged in the middle of the board. These cards are picked in accordance with the spaces on which the player pieces land. There are 28 Bonus cards, 24 Penalty cards and 9 Team Bonus cards, the numbers of which are merely exemplary. The Bonus cards include various awards such as Football Leading Passer — Collect $1,000, Hockey Leading Goal Tender — Collect $500, Baseball Golden Glove Award — Collect $250, Basketball — Most Assists — Collect $750, Baseball — Won Most Valuable Player — Collect $1,500 etc. Also included are four cards for each respective sport awarding one free player, indicating the Player Became Free Agent. This feature will be explained more fully hereinafter, as will be the Team Bonus cards. Various Penalty cards provide such fines as Football team finished last — fined $1,000 for each player owned, Hockey — Cross Checking — fined $150, Baseball pitcher threw bean ball — fined $500, Basket-ball — goal tending — fined $250, and Go to Penalty Box — Roll 7 to go out. The Penalty box 44 is the next space at the corner. When a player piece lands on this space, the piece remains there until the player rolls a seven on the dice. He can then move the piece to the Out portion of the box and move out on the next turn.

Continuing along the top row is space 46 indicating the Kings hockey team having a blue border and a price of $4,000, space 48 indicating Taxi Service — Pay $150, and space 50 indicating ABC Television Station — Price $500. The player landing on this space may purchase the station if not already owned by another player. Thereafter other players landing on that space must pay the owner $500. In addition, there are two other television stations on the next two sides of the board. If the same player owns two stations, he collects $1,200 from the others landing on these spaces, and $2,500 if he owns all three stations. Corresponding TV station cards are provided to the purchasers to show ownership and instructions on the back give the fees to be collected for various numbers of stations owned.

The next space 52 indicates the Pistons basketball team with a price of $1,000 and a red border. Space 54 indicates a Penalty card which the player must pick from the top of the Penalty card stack 42. The used Bonus and Penalty cards are left face up. When all cards are used, the stacks are mixed and restarted. The next space 56 is the Bruins hockey team priced at $2,000 and having a purple border, followed by another Bonus space 58. Space 60 is the Phillies baseball team at a price of $6,500 with an orange border, followed by space 62 indicating the Jets football team with a price of $15,000 and a green border.

The next corner space 64 indicates a Team Bonus Card, which is taken from stack 40 only when the player owns one or more full teams. Examples of these are Baseball — Won World Series — Collect $70,000, Football — Won Super Bowl — Collect $100,000, Hockey — Won Stanley Cup — Collect $40,000, Basketball — Won Playoffs — Collect $5,000 and Super Bonus For Each Team Owned — Collect $100,000 For Each Full Team. The purchase of team players and full teams will be discussed hereinafter.

Space 66 along the right side indicates another Penalty Card selected from stack 42. Space 68 indicates the Dodgers baseball team having a price of $8,000 and a blue border, and space 70 indicates the Celtics basketball team with a cost of $1,000 and a purple border. Space 72 indicates CBS Television Station having a price of $500, space 74 indicates the Red Wings hockey team having a cost of $2,500 and a red border, and space 76 indicates the Commissioner's Office — Pay $500. Space 78 is the Knicks basketball team priced at $5,000 and having a green border, space 80 is the Eagles football team with a price of $9,000 and an orange border, and space 82 is another Bonus Card selected from stack 38.

Figure 5:
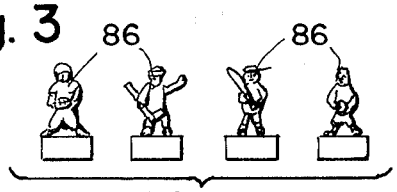
FIG. 5 represents team players of various sports.
Figure 6:
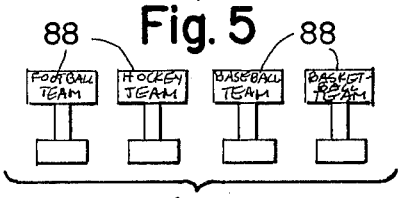
FIG. 6 represents team markers indicating a full team of players of the several sports.

The next corner space 84 indicates Buy Players and Teams — 2 Players or Less — Price $500 each. This space permits the players whose pieces land there to buy one or two team players for a team that is owned. As shown in FIG. 5 the team players 86 are in the form of small football, hockey, baseball and basketball figures. A full football team requires eleven team players, a full hockey team has six players, a full baseball team has nine players, and a full basketball team includes five players. Upon purchase of the last team player to complete a team, the individual player figures may be traded in for a full team marker 88, as shown in FIG. 6 for the various team sports. When player pieces land on team spaces owned by another player, the various penalties paid to the owner increase with the number of teams of the same color and number of team players owned. Each team space is represented by a team card held by the owner. The backs of the cards include the various payments to be made to the owner as follows.

Green Teams

Jets — Bonus $1000 (with no team players), 1 player — $2,000, 2 — $2,500, 3 — $3,000, 4 — $3,500, 5 — $4,000, 6 — $4,500, 7 — $5,000, 8 — $6,000, 9 — $7,000, 10 — $8,000, and full team — $25,000.

Mets — Bonus $900, 1 player — $1,800, 2 — $2,300, 3 — $2,800, 4 — $3,300, 5 — $3,800, 6 — $4,300, 7 — $4,800, 8 — $5,300, and full team $15,000.

Rangers — Bonus $800, 1 — $1,600, 2 — $2,100, 3 — $2,600, 4 — $3,100, 5 — $3,600, full team — $10,000.

Knicks — Bonus $700, 1 — $1,400, 2 — $1,900, 3 — $2,400, 4 — $2,900, full team — $7,000.

Blue Teams

Rams — Bonus $900, 1 player — $1,800, 2 — $2,300, 3 — $2,800, 4 — $3,300, 5 — $3,800, 6 — $4,300, 7 — $4,800, 8 — $5,300, 9 — $5,800, 10 — $6,300, and full team $15,000.

Dodgers — Bonus $800, 1 — $1,600, 2 — $2,100, 3 — $2,600, 4 — $3,100, 5 — $3,600, 6 — $4,100, 7 — $4,600, 8 — $5,100, full team $10,000.

Kings — Bonus $700, 1 — $1,400, 2 — $1,900, 3 — $2,400, 4 — $2,900, 5 — $3,400, full team — $7,000.

Lakers — Bonus — $600, 1 — $1,200, 2 — $1,700, 3 — $2,200, 4 — $2,700, full team — $5,000.

Orange Teams

Eagles — Bonus $800, 1 — $1,600, 2 — $2,100, 3 — $2,600, 4 — $3,100, 5 — $3,600, 6 — $4,100, 7 — $4,600, 8 — $5,100, 9 — $5,600, 10 — $6,100, full team $10,000.

Phillies — Bonus $700, 1 — $1,400, 2 — $1,900, 3 — $2,400, 4 — $2,900, 5 — $3,400, 6 — $3,900, 7 — $4,400, 8 — $4,900, full team $7,000.

Flyers — Bonus $600, 1 — $1,200, 2 — $1,700, 3 — $2,200, 4 — $2,700, 5 — $3,200, full team $5,000.

76ers — Bonus $500, 1 — $1,000, 2 — $1,500, 3 — $2,000, 4 — $2,500, full team — $4,000.

Red Teams

Lions — Bonus $700, 1 — $1,400, 2 — $1,900, 3 — $2,400, 4 — $2,900, 5 — $3,400, 6 — $3,900, 7 — $4,400, 8 — $4,900, 9 — $5,400, 10 — $5,900, full team $9000.

Tigers — Bonus $600 — 1 — $1,200, 2 — $1,700, 3 — $2,200, 4 — $2,700, 5 — $3,200, 6 — $3,700, 7 — $4,200, 8 — $4,700, full team $7,000.

Red Wings — Bonus $500, 1 — $1,000, 2 — $1,500, 3 — $2,000, 4 — $2,500, 5 — $3,000, full team — $6,000.

Pistons — Bonus $400, 1 — $800, 2 — $1,300, 3 — $1,800, 4 — $2,300, full team — $4,000.

Purple Teams

Patriots — Bonus $600, 1 — $1,200, 2 — $1,700, 3 — $2,200, 4 — $2,700, 5 — $3,200, 6 — $3,700, 7 — $4,200, 8 — $4,700, 9 — $5,200, 10 — $5,700, full team $8,000.

Red Sox — Bonus $500, 1 — $1,000, 2 — $1,500, 3 — $2,000, 4 — $2,500, 5 — $3,000, 6 — $3,500, 7 — $4,000, 8 — $4,500, full team $6,000.

Bruins — Bonus $400, 1 — $800, 2 — $1,300, 3 — $1,800, 4 — $2,300, 5 — $2,800, full team $5,000.

Celtics — Bonus $300, 1 — $600, 2 — $1,100, 3 — $1,600, 4 — $2,100, full team — $4,000.

These various sums are multiplied by two, three or four times if the owner also owns two, three or four teams of the same color set. The previously mentioned Bonus Cards awarding a free player can be used by an owner of any team to obtain an additional team player for the particular sport indicated on the card. The card may be kept until the person buys a team involved in that sport.

Continuing on the bottom side of the board, the next space 90 indicates the Lions football team having a price of $7,000 and a red colored border. Space 92 indicates an award wherein the Commissioner's Office Pays $100. Space 94 is another television station, NBC, which can be purchased for $500, or the owner must be paid the sums noted on the corresponding card. The next space 96 indicates a Hot Dog Stand and requires a payment to the Commissioner of $100. The following spaces 98, 100, 102 and 104 are respectively the Lakers basketball team at a price of $2,500 and blue border, the Flyers hockey team at $4,000 with an orange border, the Patriots football team for $5,000 and a purple border, and the Mets baseball team at $12,000 and a green border. The last space 106 is another Penalty card.

The player pieces continue around the board in the order originally chosen. This is preferably determined before the start of the game by numbers on the tossed dice. As many as eight persons may play, limited only by the number of player pieces, as shown in FIG. 3, which represent various sports items such as an ice skate shoe, a hockey puck, a baseball, a bat, a basketball, a baseball glove, a hockey stick and a football. These pieces are preferably of plastic and about 1¼ inches in height. The various team player figures and full team marker are also preferably of plastic and may be about three-fourths inches in height.

As noted, the Commissioner pays and collects awards, bonuses and penalties not associated with those required by player pieces landing on teams or television stations owned by other players. When a player needs money, he may auction off any of the cards he owns to the highest bidder. If there are no buyers, the Commissioner's office must buy the cards at one half the original price. Team players are also sold back to the Commissioner for half price. The winner of the game may be the person having the most money after a given time limit, or when one player has no money left or one player accumulates all of the money.

While only one specific embodiment has been fully illustrated and described, it is apparent that many variations may be made in the particular configuration and rules of the game without departing from the scope of the invention as set forth in the appended claims.

What is claimed is:

1. A game apparatus comprising:

a. a playing board including a continuous path of successive delineated spaces, a plurality of said spaces having indicia thereon related to sports teams and purchase prices for said teams, groups of said teams being related to the same sport;

b. a plurality of player pieces to indicate individual players;

c. a means of chance to indicate the movement of each player piece in turn a number of spaces along said path;

d. a plurality of stacks of cards having indicia thereon the terms of which relate respectively to awards and penalties, designated spaces in said path being associated with particular stacks;

e. a plurality of team player markers, groups of said markers being related to particular sports; and f. a supply of play money for payment of various purchases, awards and penalties.

2. The game apparatus of claim 1 wherein groups of said spaces related to sports teams of different sports include common indicia.

3. The game apparatus of claim 2 wherein one of said spaces has indicia thereon permitting purchase of team player markers.

4. The game apparatus of claim 3 including full team markers representing ownership of a given number of team player markers for a given sports team.

5. The game apparatus of claim 4 wherein a plurality of said spaces have indicia thereon related to television stations and purchase prices therefor.

6. The game apparatus of claim 5 wherein one of said stacks of cards has indicia thereon related to team bonuses and a space on said board has like indicia permitting use of a team bonus card only by owners of a full team.

7. The game apparatus of claim 6 wherein one of said spaces indicates the start of the game and a monetary award upon passing said start space.

8. The game apparatus of claim 7 wherein one of said spaces indicates a penalty box, a player piece being required to remain in said box until attaining a given number on said means of chance.

9. The game apparatus of claim 8 wherein said board is rectangular and includes four sides, each of said sides including five sports teams of different common indicia groups.

10. The game apparatus of claim 9 including a plurality of cards having indicia thereon relates to respective said sports team spaces, said cards representing ownership of said teams and indicating monetary awards related to said ownership.

* * * * *